US008931886B2

(12) United States Patent
Hoshino

(10) Patent No.: US 8,931,886 B2
(45) Date of Patent: Jan. 13, 2015

(54) INKJET HEAD AND METHOD FOR MANUFACTURING INKJET HEAD

(71) Applicants: Kabushiki Kaisha Toshiba, Minato-ku, Tokyo (JP); Toshiba Tec Kabushiki Kaisha, Shinagawa-ku, Tokyo (JP)

(72) Inventor: Tomoki Hoshino, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/100,233

(22) Filed: Dec. 9, 2013

(65) Prior Publication Data

US 2014/0160208 A1 Jun. 12, 2014

(30) Foreign Application Priority Data

Dec. 12, 2012 (JP) ..... 2012-271489

(51) Int. Cl.

*B41J 2/05* (2006.01)
*B41J 2/16* (2006.01)
*B41J 2/14* (2006.01)

(52) U.S. Cl.

CPC ..... *B41J 2/164* (2013.01); *B41J 2/1628* (2013.01); *B41J 2/14209* (2013.01); *B41J 2/1609* (2013.01); *B41J 2/1623* (2013.01); *B41J 2/1643* (2013.01); *B41J 2002/14491* (2013.01); *B41J 2202/12* (2013.01)

USPC ..... 347/58

(58) Field of Classification Search

CPC .... B41J 2/14072; B41J 2/14201; B41J 2/164; B41J 2/1607; B41J 2/1609; B41J 2002/14491; B41J 2002/14459

USPC ..... 347/68–72, 54, 57, 58

See application file for complete search history.

(56) References Cited

U.S. PATENT DOCUMENTS

| | | | | |
|---|---|---|---|---|
| 6,682,180 | B2 * | 1/2004 | Sakamoto et al. | 347/70 |
| 7,607,761 | B2 * | 10/2009 | Tanaka et al. | 347/68 |
| 8,459,781 | B2 * | 6/2013 | Ohsawa | 347/68 |
| 2003/0052949 | A1 | 3/2003 | Watanabe | |
| 2013/0208055 | A1 | 8/2013 | Hoshino et al. | |

FOREIGN PATENT DOCUMENTS

| | | |
|---|---|---|
| JP | 2009-202473 | 9/2009 |

* cited by examiner

*Primary Examiner* — An Do

(74) *Attorney, Agent, or Firm* — Amin, Turocy & Watson, LLP

(57) ABSTRACT

An inkjet head according to an embodiment includes a base portion, a driving element, a wire, a protection portion, and a boundary portion. The base portion includes a mounting surface. The driving element is mounted on the base portion. The wire is formed on the mounting surface and connected to the driving element. The protection portion is formed on the mounting surface, covering a portion of the driving element and the wire, and possesses an insulation property. The boundary portion is provided at an end of the protection portion contacting the wire that is exposed. The boundary portion is thinner than the protection portion and possesses an insulation property. Thus, an inkjet head in which stripping of an insulating portion can be restrained is provided.

3 Claims, 4 Drawing Sheets

INKJET HEAD AND METHOD FOR MANUFACTURING INKJET HEAD

CROSS-REFERENCE TO RELATED APPLICATION

This application is based upon and claims the benefit of priority from Japanese Patent Application No. 2012-271489, filed Dec. 12, 2012, the entire contents of which are incorporated herein by reference.

FIELD

Embodiments described herein relate generally to an inkjet head and a method for manufacturing an inkjet head.

BACKGROUND

An inkjet recording device such as an inkjet printer has an inkjet head that ejects ink. For example, a share mode type inkjet head has a driving element that pressurizes ink and thus causes the ink to be ejected.

The driving element includes, for example, a pressure chamber supplied with ink, and an electrode covering an inner surface of the pressure chamber. When a voltage is applied to the electrode, a wall portion prescribing the pressure chamber undergoes share-mode deformation and pressurizes the ink filling the pressure chamber. A drive circuit is connected to the electrode via a wire and applies a voltage to the electrode.

An insulating film is formed on the electrode, for example, in order to prevent a short circuit or corrosion of the electrode due to aqueous ink. The insulating film is removed from a portion of the wire to which the drive circuit is connected. The insulating film is removed after film formation, for example, by masking.

In the case where the insulating film is removed by masking, when the masking tape is stripped, a force in the direction of stripping also acts on the remaining insulating film. Therefore, an end of the insulating film may be separated, causing the insulating film to be stripped off.

DETAILED DESCRIPTION

In general, according to one embodiment, an inkjet head includes abase portion, a driving element, a wire, a protection portion, and a boundary portion. The base portion includes amounting surface. The driving element is mounted on the base portion. The wire is formed on the mounting surface and connected to the driving element. The protection portion is formed on the mounting surface, covering a portion of the driving element and the wire, and possesses an insulation property. The boundary portion is provided at an end of the protection portion contacting the wire that is exposed. The boundary portion is thinner than the protection portion and possesses an insulation property.

Hereinafter, an embodiment will be described with reference to FIGS. 1 to 5. Each element that can be expressed in plural ways may be given one or more other expression examples. However, this is not to deny different expressions of an element that is not given any other expression, and not to limit other expressions that are not given as examples, either.

Figure 1:
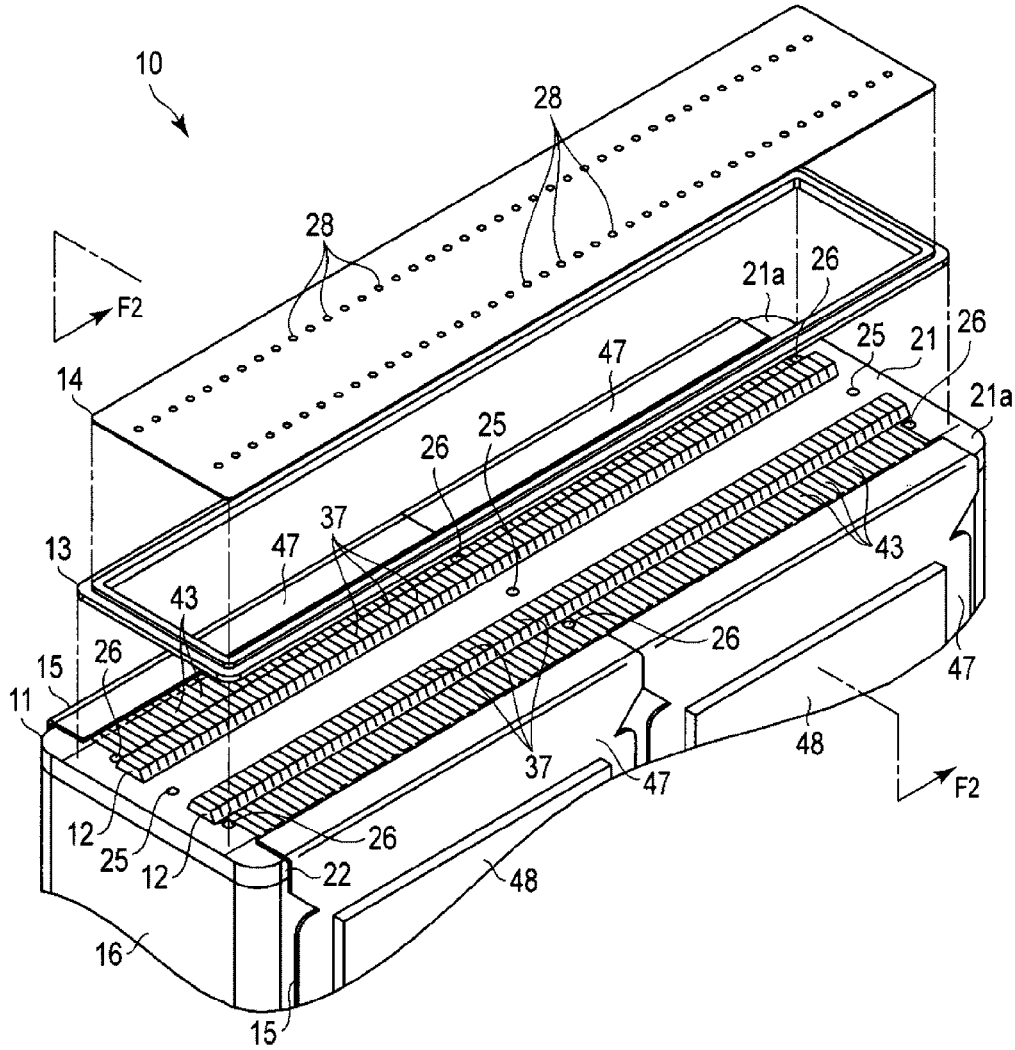
FIG. 1 is an exploded perspective view showing an inkjet head according to an embodiment.
Figure 2:
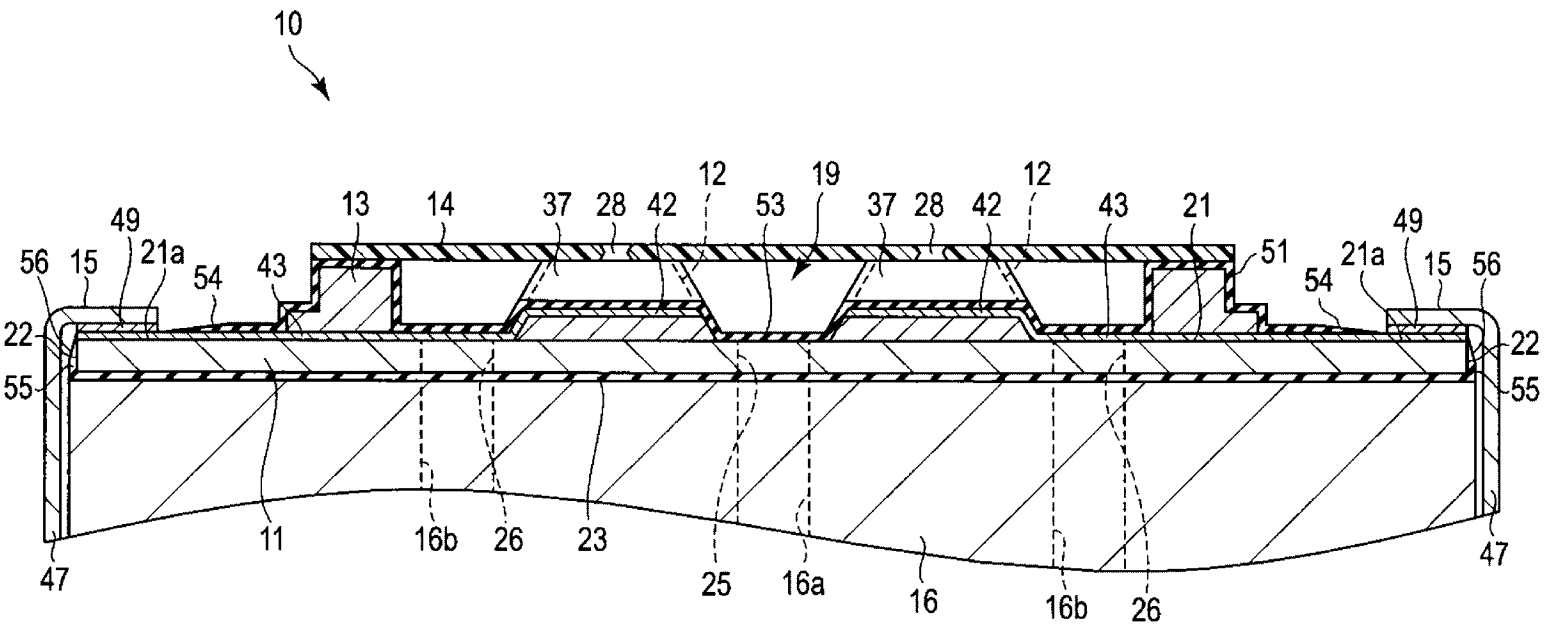
FIG. 2 is a sectional view showing the inkjet head along a line F2-F2 in FIG. 1.

FIG. 1 is an exploded perspective view showing an inkjet head 10 according to an embodiment. FIG. 2 is a sectional view showing the inkjet head 10 along a line F2-F2 in FIG. 1. As shown in FIGS. 1 and 2, the inkjet head 10 is a so-called side-shooter share mode type inkjet head.

The inkjet head 10 includes a substrate 11, a pair of driving elements 12, a frame member 13, an orifice plate 14, a pair of circuit boards 15, and a manifold 16. The substrate 11 is an example of a base portion. The circuit board 15 is an example of a drive circuit. Inside the inkjet head 10, an ink chamber 19 shown in FIG. 2 is formed.

The substrate 11 is formed in the shape of a rectangular plate made of a ceramic, for example, alumina. As shown in FIG. 2, the substrate 11 includes a flat mounting surface 21, a pair of lateral surfaces 22, and a bottom surface 23. The pair of lateral surfaces 22 is end surfaces in the short-side direction of the rectangular substrate 11 and each lateral surface is orthogonal to the mounting surface 21. The bottom surface 23 is situated opposite to the mounting surface 21. The mounting surface 21 is provided with plural supply holes 25 and plural discharge holes 26.

The plural supply holes 25 are arrayed in the longitudinal direction of the substrate 11, in a central portion of the substrate 11. The supply holes 25 communicate with an ink supply portion 16*a* of the manifold 16. The supply holes 25 are connected to an ink tank via the ink supply portion 16*a*.

The plural discharge holes 26 are arrayed in two lines with the supply holes 25 located in-between. The discharge holes 26 communicate with an ink discharge portion 16*b* of the manifold 16. The discharge holes 26 are connected to the ink tank via the ink discharge portion 16*b*.

As shown in FIG. 1, the orifice plate 14 is formed by a rectangular film made of, for example, polyimide. The orifice plate 14 may also be made of other material such as stainless steel. The orifice plate 14 is opposite the mounting surface 21 of the substrate 11.

The orifice plate 14 is provided with plural orifices 28. The plural orifices 28 are arrayed in two lines along the longitudinal direction of the orifice plate 14. The orifices 28 are opposite the portions between the supply holes 25 and the discharge holes 26 in the mounting surface 21.

The frame member 13 is formed in the shape of a rectangular frame made of, for example, a nickel alloy. The frame member 13 is provided between the mounting surface 21 of the substrate 11 and the orifice plate 14. The frame member 13 is adhered to each of the mounting surface 21 and the orifice plate 14.

As shown in FIG. 2, the ink chamber 19 is formed by being surrounded by the substrate 11, the orifice plate 14 and the frame member 13. The ink in the ink tank is supplied to the ink chamber 19 from the supply holes 25.

The pair of driving elements 12 is formed by two plate-like piezoelectric members made of, for example, lead zirconate titanate (PZT). The two piezoelectric members are bonded together in such a way that these members have opposite polarization directions to each other in direction of thickness.

The pair of driving elements 12 is adhered to the mounting surface 21 of the substrate 11. The driving elements 12 are arranged parallel to each other inside the ink chamber 19, corresponding to the two lines of orifices 28. The driving elements 12 are surrounded by the frame member 13. Top parts of the driving elements 12 are adhered to the orifice plate 14.

The driving elements 12 are provided with plural pressure chambers 37. The pressure chambers 37 are grooves formed in the driving elements 12. The pressure chambers 37 extend respectively in directions orthogonal to the longitudinal direction of the driving elements 12 and are arrayed in the longitudinal direction of the driving elements 12.

The plural orifices 28 of the orifice plate 14 open into the plural pressure chambers 37. The pressure chambers 37 are opened to the ink chamber 19. In other words, the pressure chambers 37 and the ink chamber 19 communicates with each other. Therefore, the ink flows between the pressure chambers 37 of the driving elements 12 and the ink chamber 19. The ink fills the pressure chambers 37 and passes through the pressure chambers 37.

Each of the pressure chambers 37 is provided with an electrode 42. The electrode 42 is formed, for example, by a nickel thin film. The electrode 42 covers the inner surface of the pressure chamber 37.

Plural wiring patterns 43 are provided from the mounting surface 21 of the substrate 11 to the driving elements 12. The wiring patterns 43 are an example of a wire. The wiring patterns 43 are formed, for example, by a nickel thin film and connected to the corresponding electrodes 42.

Each of the wiring patterns 43 extends from the electrode 42 formed in the pressure chamber 37 of the driving element 12 to a lateral end portion 21*a* of the mounting surface 21. The wiring patterns 43 are laid between the substrate 11 and the frame member 13. The wiring patterns 43 are insulated from the frame member 13, for example, via an adhesive.

The lateral end portion 21*a* is an end in the short-side direction of the mounting surface 21. The lateral end portion 21*a* includes not only an edge of the mounting surface 21 but also a predetermined area adjacent to the edge. In other words, the lateral end portion 21*a* is an area along the lateral surface 22 of the substrate 11. In FIG. 1, the lateral end portion 21*a* is distinguished from other parts of the mounting surface 21 by a chain double-dashed line.

As shown in FIG. 1, each of the circuit boards 15 is a film carrier package (FCP) and includes a resin film 47 and a drive IC 48. The FCP is also referred to as tape carrier package (TCP).

The film 47 has plural wires formed thereon and has flexibility. The film 47 is formed, for example, by tape automated bonding (TAB).

The drive IC 48 is connected to the plural wires on the film 47. The drive IC 48 is a component that applies a pulse signal (voltage) to the electrode 42 of the driving element 12 via the wiring patterns 43. The drive IC 48 is fixed to the film 47, for example, with a resin.

As shown in FIG. 2, an end of the film 47 is connected to the wiring pattern 43 in the lateral end portion 21*a* of the mounting surface 21 by thermocompression bonding with an anisotropic conductive film (ACF) 49. Thus, the plural wires on the film 47 are electrically connected to the wiring patterns 43. As the film 47 is connected to the wiring pattern 43, the drive IC 48 is electrically connected to the electrode 42 via the wiring of the film 47.

When the drive IC 48 applies a voltage to the electrode 42 via the wiring pattern 43, the driving element 12 undergoes share-mode modification. Thus, the volume of the pressure chamber 37 provided with the electrode 42 changes and the ink filling the pressure chamber 37 is pressurized. The pressurized ink is ejected from the orifice 28.

As shown in FIG. 2, an insulating film 51 is provided in the inkjet head 10. In order to facilitate understanding of the configuration of the inkjet head 10, FIG. 1 does not show the insulating film 51.

The insulating film 51 is made of, for example, parylene C. However, the insulting film 51 is not limited to this example and may also be made of parylene D, parylene N or other organic materials with an insulation property.

The insulating film 51 covers a portion of the substrate 11, a portion of the wiring patterns 43, the driving elements 12, the electrodes 42, and the frame member 13. The conductive part in the ink chamber 19 is covered by the insulating film 51.

The lateral end portions 21*a* of the mounting surface 21 and a part of the wiring patterns 43 provided on the lateral end portions 21*a* are exposed without being covered by the insulating film 51. The circuit boards 15 are connected to the wiring patterns 43 on the exposed lateral end portions 21*a*.

The insulating film 51 includes a protection portion 53, a pair of boundary portions 54, a pair of lateral protection portions 55, and a pair of lateral boundary portions 56. The protection portion 53, the boundary portions 54, the lateral protection portions 55 and the lateral boundary portions 56 are integrally formed. However, a part of the insulating film 51 may be formed separately from the other parts.

The protection portion 53 is formed on the mounting surface 21. The protection 53 covers the driving elements 12, the frame member 13, the electrodes 42, a part of the mounting surface 21 except the lateral end portions 21*a*, and the wiring patterns 43 provided at this part of the mounting surface 21. The protection portion 53 has a uniform thickness of, for example, 1 to 10 [μm].

The pair of boundary portions 54 is provided respectively at ends of the protection portion 53 in the short-side direction of the mounting surface 21. In other words, the boundary portions 54 are provided at ends of the protection portion 53 contacting the wiring patterns 43 on the exposed lateral end portions 21*a*. To rephrase this further, the boundary portions 54 are end portions of the insulating film 51 that expose a part of the wiring patterns 43. The boundary portions 54 cover a part of the wiring patterns 43 that is situated outside the frame member 13.

The thickness of the boundary portions 54 gradually decreases as it goes toward the wiring patterns 43 on the exposed lateral end portions 21*a*. In other words, the boundary portions 54 gradually become thinner as these portions go toward the edge. The boundary portions 54 are inclined with respect to the wiring patterns 43. The thickness of the boundary portions 54 is thinner than the thickness of the protection portion 53.

As described above, the mounting surface 21 includes the area covered by the insulating film 51 and the area exposed without being covered by the insulating film 51 (lateral end portions 21*a*). In the boundary portion between the area covered by the insulating film 51 and the exposed area, the thickness of the insulating film 51 gradually becomes thinner as it goes toward the exposed area. The insulating film 51, gradually becoming thinner, disappears as it reaches the exposed area.

The lateral protection portions 55 cover a portion of the lateral surfaces 22 of the substrate 11. The lateral protection portions 55 continue to a portion of the insulating film 51 that covers the bottom surface 23 and the end surfaces of in the longitudinal direction of the substrate 11. The thickness of the lateral protection portions 55 is uniform and equal to the thickness of the protection portion 53. However, the thickness of the lateral protection portions 55 may be different from the thickness of the protection portion 53.

The lateral boundary portions 56 are provided at ends of the lateral protection portions 55 that face the mounting surface 21. The lateral boundary portions 56 are provided from the ends of the lateral protection portions 55 to the edge portions between the mounting surface 21 and the lateral surfaces 22. The lateral surfaces 22 are covered by the lateral protection portions 55 and the lateral boundary portions 56. However, a part of the lateral surfaces 22 may be exposed.

The thickness of the lateral boundary portions 56 gradually decreases as it goes toward the edge portions between the mounting surface 21 and the lateral surfaces 22. In other words, the lateral boundary portions 56 gradually become thinner as these portions go toward the edges. The lateral boundary portions 56 are inclined with respect to the lateral surfaces 22. However, the lateral boundary portions 56 are not limited to this example and may have, for example, a step or a concave-convex form, or may have a portion parallel to the lateral surface 22. The thickness of the lateral boundary portions 56 is thinner than the thickness of the lateral protection portions 55.

Next, an example of a method for manufacturing the inkjet head 10 will be described with reference to FIGS. 3 to 5. First, in the substrate 11 formed by a ceramic sheet (ceramic green sheet) before burning, the supply holes 25 and the discharge holes 26 are formed by press molding. Subsequently, the substrate 11 is burnt.

Next, the driving elements 12 (piezoelectric members) before processing are adhered to the mounting surface 21 of the substrate 11. At this time, the pair of driving element 12 is maintained at a predetermined distance from each other by a jig. Also, the pair of driving elements 12 is positioned via the jig. The adhesive to adhere the driving elements 12 is thermoset.

Next, grinding or cutting is carried out to the pair of driving elements 12 adhered to the substrate 11. Thus, the section of the driving elements 12 is made trapezoidal. Next, the pressure chamber 37 is formed in each of the driving elements 12. For example, a cutting machine such as a slicer cuts the driving elements 12 and thus forms the pressure chambers 37.

Next, the plural electrodes 42 and the plural wiring patterns 43 are formed. On the driving elements 12 and the mounting surface 21 of the substrate 11, for example, nickel is precipitated by electroless plating. Moreover, gold is precipitated by electroplating or electroless plating.

After a metal film is formed on the driving elements 12 and the mounting surface 21, an unnecessary portion of the metal film is removed and the plural electrodes 42 and the plural wiring patterns 43 are formed. For example, the metal film portion that is left is covered with a resist, whereas the unnecessary portion of the metal film is dissolved by etching. Alternatively, the unnecessary portion of the metal film is removed by patterning with laser irradiation.

Subsequently, the frame member 13 is adhered to the mounting surface 21 in such a way as to surround the pair of driving elements 12. The frame member 13 is fixed to the mounting surface 21 directly or via the wiring patterns 43 with an adhesive.

Figure 3:
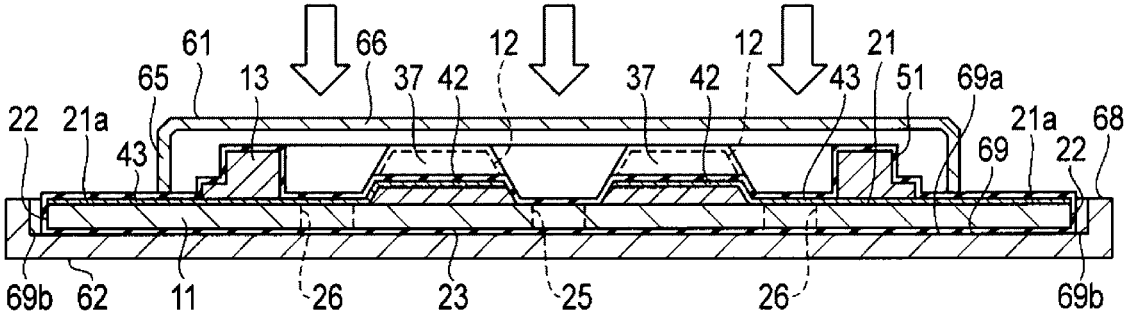
FIG. 3 is a section view showing a substrate, a driving element and a frame member during a manufacturing process.

FIG. 3 is a sectional view showing the substrate 11, the driving elements 12 and the frame member 13 during the manufacturing process. Next, the insulating film 51 is formed on the surface of the substrate 11, the driving elements 12, the frame member 13, the electrodes 42 and the wiring patterns 43, for example, by a CVD method. The thickness of the insulating film 51 is uniform and, for example, 1 to 10 [μm].

Next, a first mask 61 and a second mask 62 are attached to the substrate 11. The first mask 61 is an example of a mask. Each of the first and second masks 61, 62 is made of, for example, a metal. The first and second masks 61, 62 are not limited to this example and may be made of other materials that cannot be removed by plasma processing (plasma etching).

The first mask 61 is formed substantially in the shape of a box with one side opened, and has a peripheral wall 65 and an upper wall 66. The peripheral wall 65 is formed in the shape of a larger frame than the frame member 13. The peripheral wall 65 is placed on the mounting surface 21 and surrounds apart of the mounting surface 21, the wiring patterns 43 formed in this part of the mounting surface 21, the driving elements 12 and the frame member 13.

The upper wall 66 is opposite the mounting surface 21. The upper wall 66 covers a part of the mounting surface 21 surrounded by the peripheral wall 65, the wiring patterns 43 formed in this part of the mounting surface 21, the driving elements 12, and the frame member 13.

The lateral end portions 21*a* of the mounting surface 21 and parts of the mounting surface 21 adjacent to the lateral end portions 21*a* are situated outside the peripheral wall 65. In other words, the peripheral wall 65 is situated on the inner side of the mounting surface 21 than the lateral end portions 21*a*. Therefore, the lateral end portions 21*a* and the parts in question of the mounting surface 21 are exposed without being covered by the first mask 61.

The second mask 62 is formed substantially in the shape of a box with one side opened, and has an upper surface 68 and a concave portion 69. The upper surface 68 is flatly formed. The concave portion 69 is a substantially rectangular hole and opens to the upper surface 68.

The substrate 11 is arranged in the concave portion 69. The bottom surface 23 of the substrate 11 abuts on a bottom surface 69*a* of the concave portion 69. There is a gap between the lateral surfaces 22 of the substrate 11 and an inner peripheral surface 69*b* of the concave portion 69.

The upper surface 68 of the second mask 62 is slightly lower than the mounting surface 21. In other words, the substrate 11 arranged in the concave portion 69 protrudes from the upper surface 68 of the second mask 62.

Next, plasma processing is carried out on the substrate 11 with the first and second masks 61, 62 attached thereto. In the plasma processing, the exposed parts of the insulating film 51 that are not covered by the first and second masks 61, 62 are removed.

Figure 4:
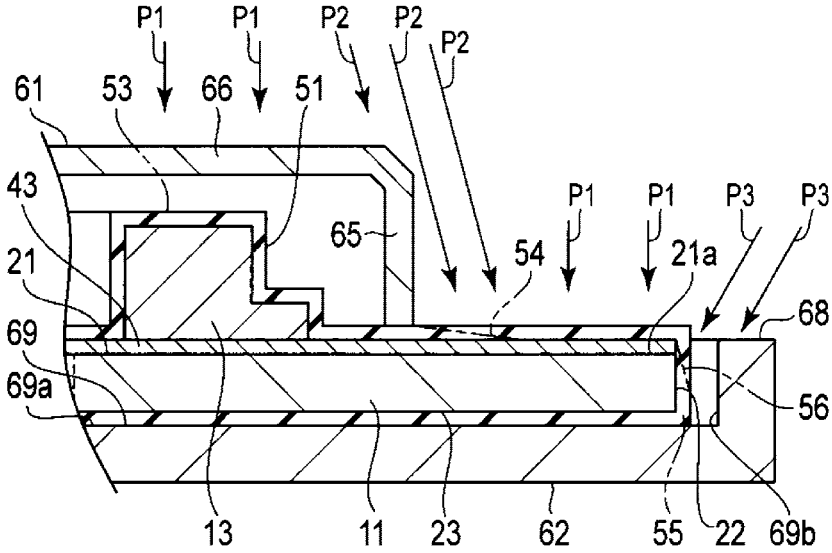
FIG. 4 is a partly enlarged sectional view showing the substrate on which plasma processing is carried out.

FIG. 4 is a partly enlarged sectional view showing the substrate 11 on which plasma processing is carried out. The plasma processing will be described in detail with reference to FIG. 4. In the plasma processing, the insulating film 51 exposed without being covered by the first and second masks 61, 62 is shaved off with the lapse of time. In other words, the insulating film 51 becomes thinner with the lapse of time and is ultimately removed.

The amount (thickness) by which the insulating film 51 is shaved off per unit time in the plasma etching varies depending on the output and the amount of oxygen inflow and is called a rate. The unit of the rate is generally [μm/minute].

As shown in FIG. 4, plasmas P1, P2, P3 strike the insulating film 51 exposed without being covered by the first and second masks 61, 62, and shave the insulating film 51 off. The plasmas P1, P2, P3 strike the insulating film 51 from plural directions.

The plasma P1 advancing perpendicularly to the mounting surface 21 strikes the exposed insulating film 51 on the mounting surface 21 substantially uniformly. Meanwhile, a part of the plasma P2 advancing obliquely with respect to the mounting surface 21 is interrupted by the first mask 61 and therefore does not strike the exposed insulating film 51.

Specifically, a part of the insulating film 51 adjacent to the first mask 61 is struck by the plasmas P1, P3 but is not struck by the plasma P2. Meanwhile, a part of the insulating film 51 away from the first mask 61 (for example, the insulating film provided at the lateral end portion 21*a*) is struck by the plasmas P1, P2, P3. Therefore, in the part adjacent to the first mask 61, of the insulating film 51, the etching rate is lower than in the part away from the first mask 61. In other words, the insulating film 51 is shaved off more quickly as it goes away from the first mask 61.

Since there is such a difference in etching rate as described above, the part of the insulating film 51 adjacent to the first mask 61 remains the time point when the insulating film 51 is removed from the lateral end portion 21*a* of the mounting surface 21. As the plasma processing is stopped at this point, the boundary portion 54 as the remaining part of the insulating film 51 is formed. The boundary portion 54 is thinner than the protection portion 53, which is a part of the insulating film 51 that is covered by the first mask 61. In FIG. 4, the boundary portion 54 is indicated by a chain double-dashed line. Also, as the insulating film 51 is removed from the lateral end portion 21*a*, the wiring pattern 43 in the lateral end portion 21*a* is exposed.

The length from the end of the protection portion 53 to the edge of the boundary portion 54 and the angle of inclination of the boundary portion 54 with respect to the mounting surface 21 can be changed according to various conditions. Such conditions include, for example, the height, position and shape of the first mask 61, the plasma output, the amount of oxygen inflow in the plasma processing, and the time of the plasma processing. For example, if the peripheral wall 65 of the first mask 61 is increased, the length of the boundary portion 54 becomes longer. Also, if the time of the plasma processing increases, the length of the boundary portion 54 becomes shorter.

The insulating film 51 formed on the lateral surface 22 is struck by the plasma P3 advancing obliquely with respect to the mounting surface 21. However, a part of the plasma P3 is interrupted by the second mask 62 and therefore does not strike the insulating film 51 on the lateral surface 22. The plasma P3 striking the insulating film 51 decreases as it goes away from the edge portion between the mounting surface 21 and the lateral surface 22. Therefore, the speed at which the insulating film 51 on the lateral surface 22 is shaved off becomes lower as it goes away from the edge portion between the mounting surface 21 and the lateral surface 22.

Since there is such a difference in etching rate as described above, a part of the insulating film 51 adjacent to the edge portion between the mounting surface 21 and the lateral surface 22 is thin at the time point when the insulating film 51 is removed from the lateral end portion 21*a* of the mounting surface 21. As the plasma processing is stopped at this point, the lateral boundary portion 56 as the thinned part of the insulating film 51 is formed. In FIG. 4, the lateral boundary portion 56 is indicated by a chain double-dashed line.

The length from the end of the lateral protection portion 55 to the edge of the lateral boundary portion 56 and the angle of inclination of the lateral boundary portion 56 with respect to the lateral surface 22 can be changed according to various conditions. Such conditions include, for example, the shape of the second mask 62, the depth of the concave portion 69, the position of the substrate 11 in the concave portion 69, the plasma output, the amount of oxygen inflow in the plasma processing, and the time of the plasma processing.

Figure 5:
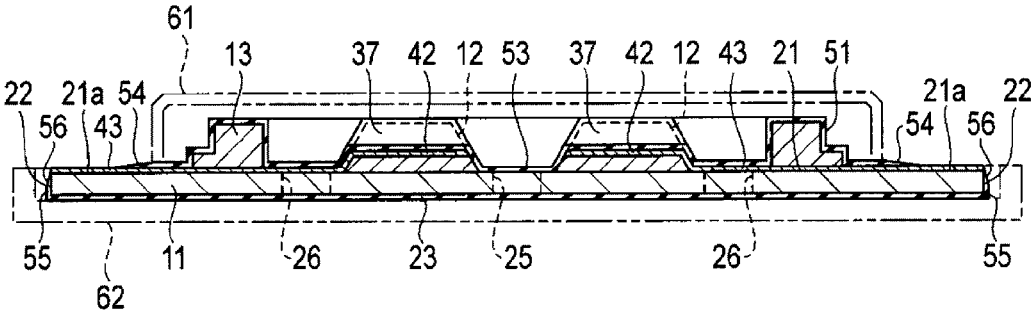
FIG. 5 is a sectional view showing the substrate, the driving element and the frame member after plasma processing.

FIG. 5 is a sectional view showing the substrate 11, the driving elements 12, and the frame member 13 after the plasma processing. When the plasma processing is finished, the first and second masks 61, 62 are detached from the substrate 11. In FIG. 5, the first and second masks 61, 62 are indicated by chain double-dashed lines.

Next, the orifice plate 14 is adhered to the frame member 13 with an adhesive. The orifice plate 14 is adhered to the frame member 13 and is also adhered to the top parts of the driving elements 12. The adhesive to adhere the orifice plate 14 is thermoset.

Next, the circuit boards 15 are mounted on the exposed wiring patterns 43 with the ACF 49. Moreover, the manifold 16 is mounted on the substrate 11. Thus, the inkjet head 10 shown in FIG. 1 is formed.

According to the inkjet head 10 of the embodiment, the thickness of the boundary portions 54 contacting the exposed wiring patterns 43 is thinner than the protection portions 53. Therefore, even if the boundary portions 54 are scratched, for example, with a nail, the boundary portions will not be easily stripped off the mounting surface. Thus, stripping of the insulating film 51 including the protection portions 53 and the boundary portions 54 from the mounting surface 21 and hence entry of ink between the insulating film 51 and the mounting surface 21 is restrained.

Moreover, the insulating film 51 is removed by plasma processing. Therefore, in removing the insulating film 51, a force in the stripping direction does not act on the insulating film 51. Thus, stripping of the insulating film 51 from the mounting surface 21 is restrained. Also, in removing the insulating film 51, generation of burrs and dust on the insulating film 51 can be restrained.

The thickness of the boundary portions 54 decreases as it goes toward the exposed wiring patterns 43. Therefore, there are fewer steps on the boundary portions 54 that may catch, for example, a nail. Thus, stripping of the insulating film 51 from the mounting surface 21 is restrained.

The lateral boundary portions 56 thinner than the lateral protection portions 55 are formed on the lateral surfaces 22. Therefore, stripping of the insulating film 51 including the lateral protection portions 55 and the lateral boundary portions 56 from the lateral surfaces 22 can be restrained.

According to at least one of the inkjet heads described above, an end portion of an insulating protection portion contacting an exposed wire is provided with a boundary portion that is thinner than the protection portion. Thus, stripping of the insulating portion including the protection portion and the boundary portion can be restrained.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, while the lateral end portions 21*a* of the mounting surface 21 are exposed without being covered by the insulating film 51 in the inkjet head 10, other portions may be exposed. Moreover, while the boundary portions 54 form flat inclined surfaces, possible configurations are not limited to this example. For example, a step or a concave-convex shape may be provided or a portion parallel to the wiring patterns 43 may be provided.

What is claimed is:

1. An inkjet head comprising:

a base portion including a mounting surface;

a driving element mounted on the base portion;

a wire formed on the mounting surface and connected to the driving element;

a protection portion formed on the mounting surface, covering a portion of the driving element and the wire, wherein the protection portion possesses an insulation property;

a lateral protection portion covering at least a part of a lateral surface of the base portion that intersects with the mounting surface, wherein the lateral protection portion possesses an insulation property; and a lateral boundary portion provided at an end of the lateral protection portion that faces the mounting surface, wherein the lateral boundary portion is thinner than the lateral protection portion and possesses an insulation property;

wherein the wire that is exposed is provided at an end of the mounting surface along the lateral surface; and a boundary portion provided at an end of the protection portion contacting the wire that is exposed, wherein the boundary portion is thinner than the protection portion and possesses an insulation property.

2. The inkjet head according to claim 1, wherein the boundary portion decreases in thickness as it goes toward the wire that is exposed.

3. The inkjet head according to claim 1, wherein a drive circuit that applies a voltage to the driving element via the wire is connected to the wire that is exposed.

* * * * *